US007694394B2

(12) United States Patent
Hasegawa et al.

(10) Patent No.: US 7,694,394 B2
(45) Date of Patent: Apr. 13, 2010

(54) BUTTON

(75) Inventors: Kenji Hasegawa, Tokyo (JP); Hiroki Sugimoto, Tokyo (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 12/241,586

(22) Filed: Sep. 30, 2008

(65) Prior Publication Data

US 2009/0083946 A1 Apr. 2, 2009

(30) Foreign Application Priority Data

Oct. 1, 2007 (JP) ..... 2007-257679

(51) Int. Cl.
*A44B 1/28* (2006.01)

(52) U.S. Cl. ..... 24/95; 24/703.4

(58) Field of Classification Search ..... 24/90.5, 24/113 R, 113 MP, 114.9, 94, 95, 114.4, 24/703.4; 411/501, 504, 506, 507, 360, 362
See application file for complete search history.

(56) References Cited

U.S. PATENT DOCUMENTS

| | | | | |
|---|---|---|---|---|
| 631,212 | A * | 8/1899 | Hormann | 24/95 |
| 4,512,063 | A * | 4/1985 | Fukuroi | 24/94 |
| 4,890,364 | A * | 1/1990 | Tanaka et al. | 24/673 |
| 5,575,043 | A | 11/1996 | Candotti | |
| 2005/0160562 | A1 * | 7/2005 | Hasegawa et al. | 24/94 |

FOREIGN PATENT DOCUMENTS

| | | |
|---|---|---|
| DE | 857870 | 12/1952 |
| JP | 57-157205 | 10/1982 |
| JP | 60-69008 | 5/1985 |
| JP | 63-303642 | 12/1988 |
| JP | 2000-106914 | 4/2000 |

* cited by examiner

*Primary Examiner*—James R Brittain
(74) *Attorney, Agent, or Firm*—Alston & Bird, LLP

(57) ABSTRACT

A button is disclosed that includes a die cast button body for which a secondary or an additional process (e.g., a squeeze process) is unnecessary and for which a degree of freedom for design of the upper surface center of the button body can increase. A shank of a fastening member is provided with a shank distal end having a small diameter, a shank proximal portion having a larger diameter than that of the shank distal end, and a shank stepped portion. A shank receiving space of the button body for receiving the shank is provided with a shank receiving small diameter portion which receives the shank distal end and which has an axial length larger than that of the distal end, a shank receiving large diameter portion which receives a distal side part of the shank proximal portion, and a shank receiving stepped portion. The shank receiving stepped portion has a stepped portion edge boundary with the small diameter portion. When the button is attached to cloth, the shank receiving stepped portion bumps into the shank stepped portion, causing the stepped portion edge to stick into the shank proximal portion.

9 Claims, 4 Drawing Sheets

【FIG. 1】
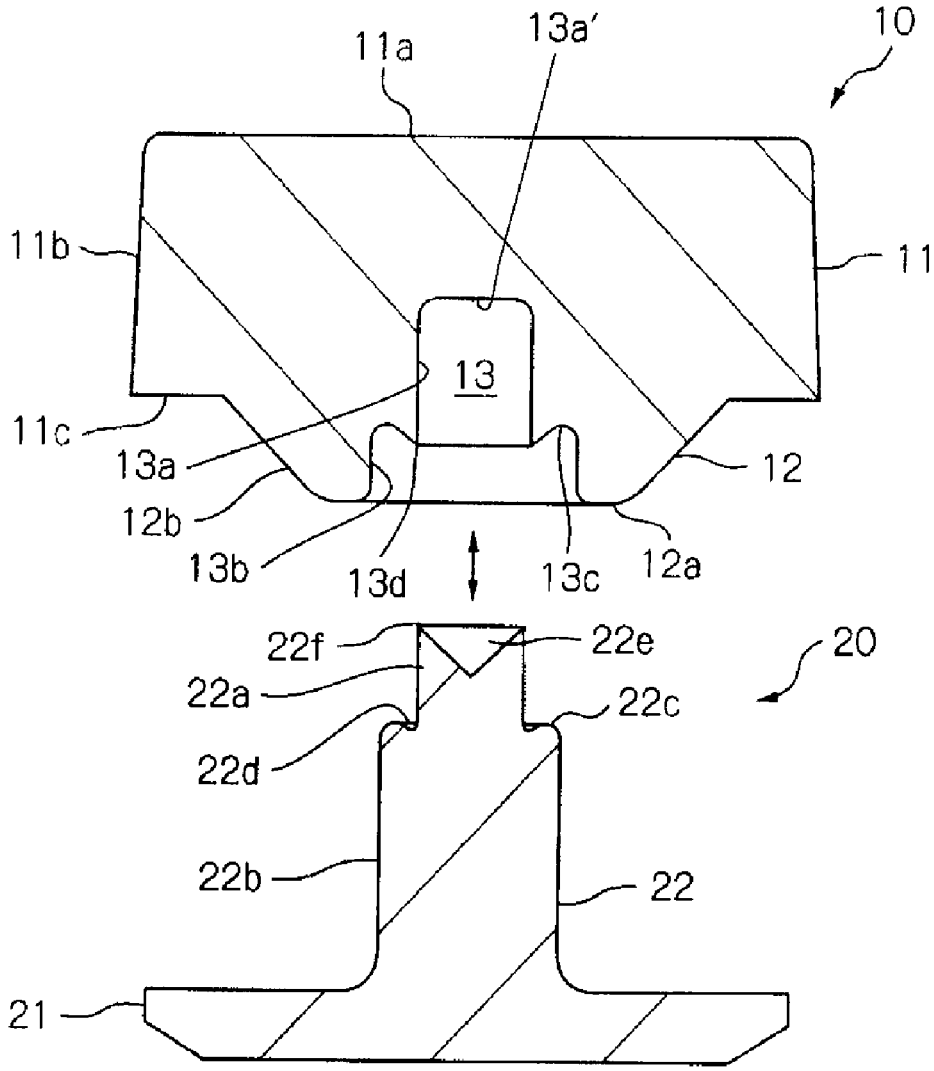

【FIG. 2】
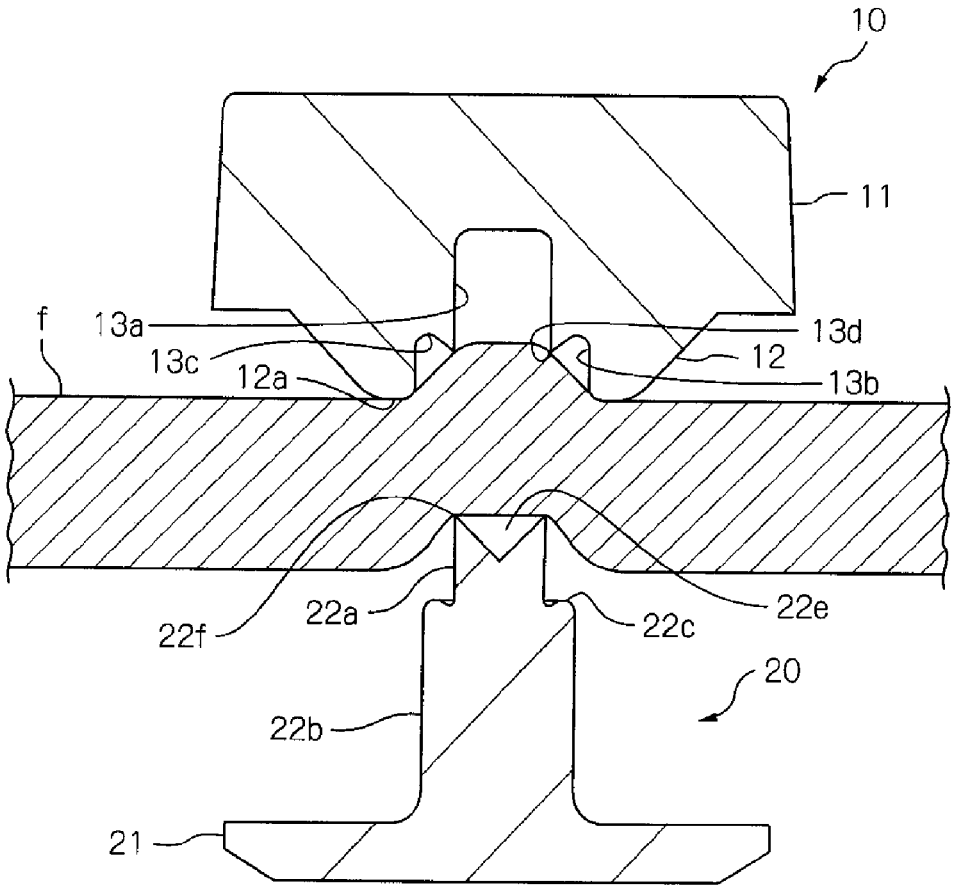

【FIG. 3】
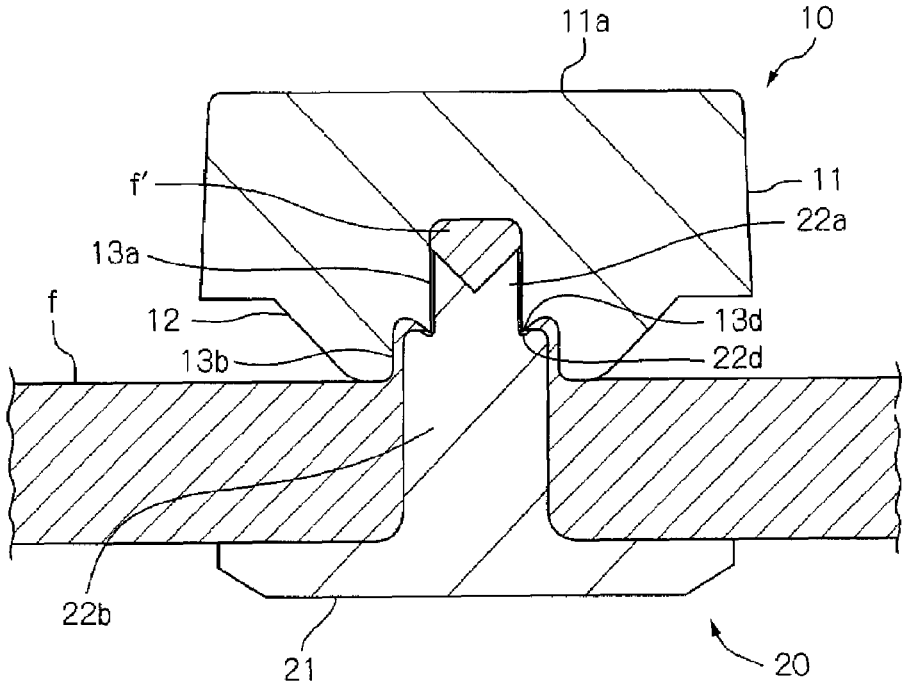
【FIG. 4】
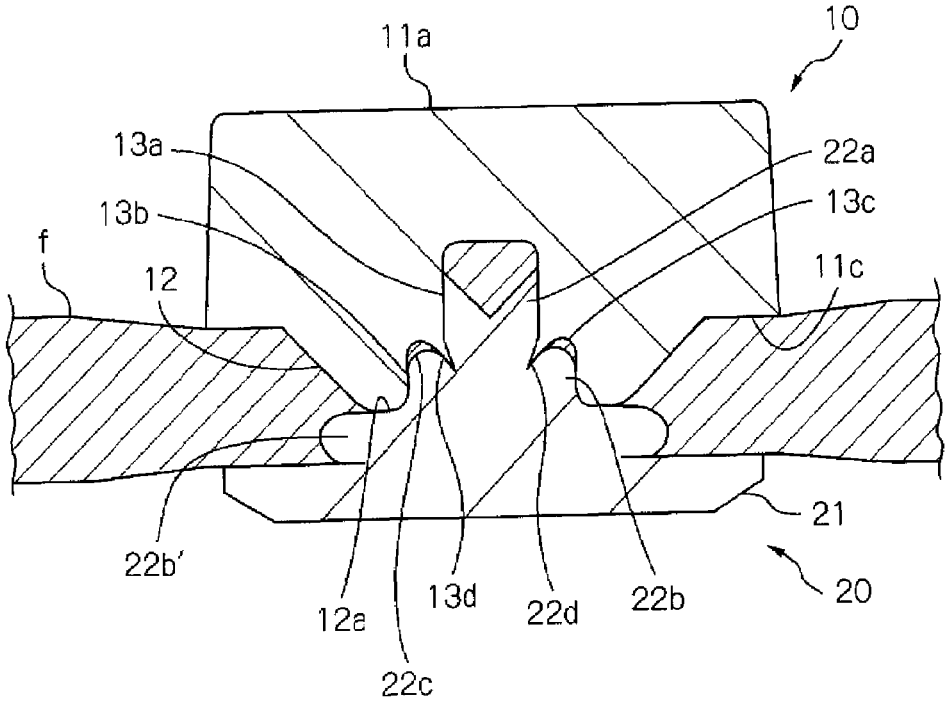

【FIG. 5】
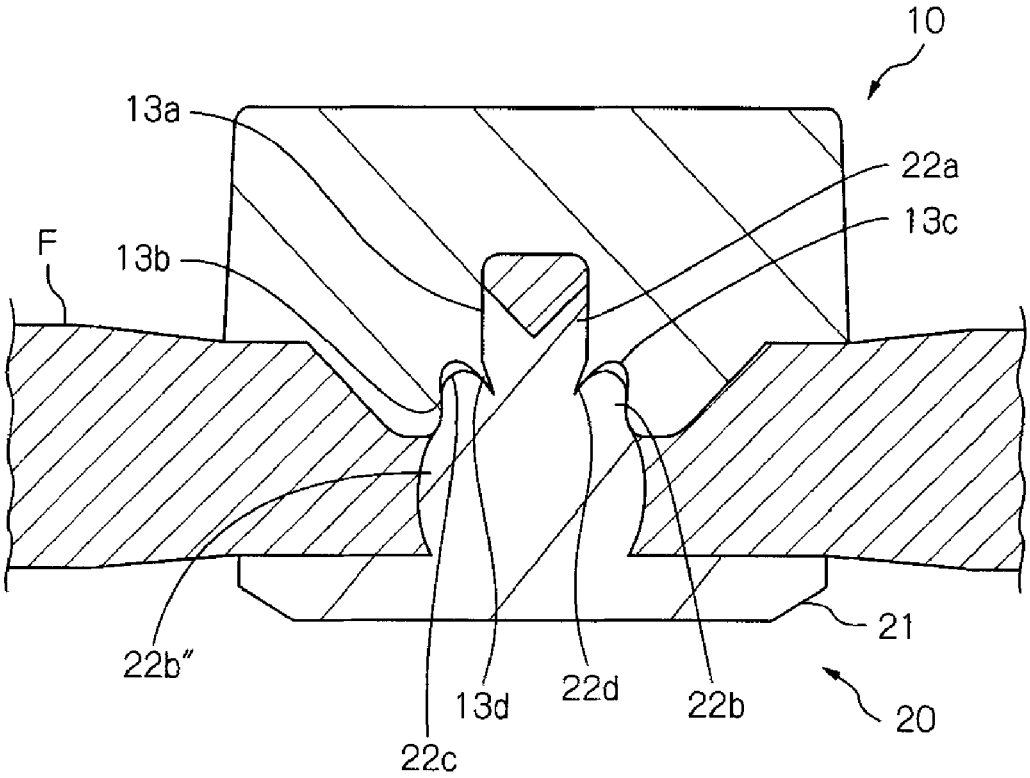
【FIG. 6】
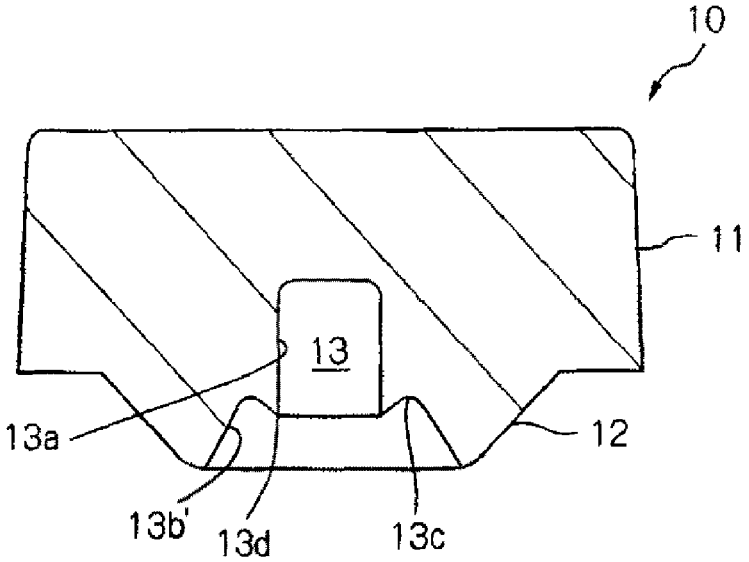

BUTTON

BACKGROUND OF THE INVENTION

1. Field of the Invention

The present invention relates to a button mainly for use as a decorative button for a denim product, a leather product or the like.

2. Description of the Related Art

In jeans or the like, there has often been used a decorative button of such a type that a bar (a button body) is fastened with a rivet, and the cloth is sandwiched between the bar and the rivet. The bar of the decorative button is made by squeezing a metal plate or the like. However, a solid die cast product is more easily manufactured in large amounts, is resistant to impact, and is not easily deformed. In addition, the outer shape of the bar can variously be designed in accordance with a die. In Japanese Patent Application Laid-Open No. 63-303642 ("the '642 application), one example of such a die cast bar is disclosed.

In a die cast bar 30 disclosed in the '642 application, a leg portion 16 of a rivet member 10 which has passed through cloth is received in an axial hole 36, and the received part of this leg portion 16 is pressed in the vertical direction and collapsed so as to expand outwardly in the radial direction, whereby the bar is fixed to the cloth (see FIG. 5 of the '642 application). In the die cast bar 30, after die casting, a central projection 34 of the bar 30 needs to be squeezed so that the expanded part of the pressed leg portion 16 is not detached from the axial hole 36 (see FIGS. 3 and 4 of the '642 application). Therefore, the manufacturing of the bar is laborious and increases cost. Furthermore, at the time of the pressing, a force to deform the leg portion 16 is transmitted from the closed bottom (the upper end) of the axial hole 36 to the center of the upper surface of the bar 30, whereby the design of this upper surface center is limited. For example, it is difficult to thin this upper surface center or to embed glass or the like vulnerable to impact in this part.

BRIEF SUMMARY OF VARIOUS EMBODIMENTS OF THE INVENTION

Various embodiments of the invention have been developed in view of the above problems, and an object thereof is to provide a button which can be obtained as a die cast product where a secondary process such as the squeeze process of a button body is unnecessary and in which a degree of freedom for the design of the upper surface center of the button body can increase.

According to various embodiments of the present invention, there is provided a button comprising a button body and a fastening member fitted to each other via a cloth. The fastening member includes a base and a shank extending from the base, and the shank includes a shank distal end having a relatively small diameter, a shank proximal portion having a diameter larger than that of the distal end, and a shank stepped portion between the distal end and the proximal portion. The button body has a shank receiving space for receiving the shank which has passed through the cloth, and the shank receiving space includes a shank receiving small diameter portion which receives the shank distal end and which has an axial length larger than that of the distal end, a shank receiving large diameter portion which receives at least a part of the shank proximal portion, and a shank receiving stepped portion between the small diameter portion and the large diameter portion. The shank receiving stepped portion has a stepped portion edge around a boundary with the small diameter portion.

Moreover, according to various embodiments of the present invention, there is provided a button that includes a button body and a fastening member fitted to the button body via a cloth. The fastening member includes a base and a shank extending from the base, and the shank includes a shank distal end having a relatively small diameter, a shank proximal portion having a diameter larger than that of the distal end, and a shank stepped portion between the distal end and the proximal portion. The button body has a shank receiving space for receiving the shank which has passed through the cloth, and the shank receiving space includes a shank receiving small diameter portion which receives the shank distal end and which has an axial length larger than that of the distal end, a shank receiving large diameter portion which receives at least a part of the shank proximal portion, and a shank receiving stepped portion between the small diameter portion and the large diameter portion. The shank receiving stepped portion has a stepped portion edge around a boundary with the small diameter portion, wherein the button body is combined with the fastening member by making the shank stepped portion bump into the shank receiving stepped portion, causing the stepped portion edge to stick into the shank proximal portion.

According to various embodiments of the present invention, at the time of pressing the button and the fastening member to each other to attach them to the cloth, the shank distal end which has passed through the cloth enters the shank receiving small diameter portion, where since the axial length of the shank receiving small diameter portion is larger than that of the shank distal end, the shank stepped portion bumps into the shank receiving stepped portion, which prevents the shank distal end from further going into the shank receiving small diameter portion, before the top of the shank distal end reaches the closed bottom (the opposite end to the open end of the shank receiving space) of the shank receiving small diameter portion. At this time, a force is applied from the shank receiving stepped portion to the shank stepped portion, and this force allows the stepped portion edge of the shank receiving stepped portion to stick into a shank proximal portion from the shank stepped portion, whereby the button body is fitted to the fastening member with the cloth sandwiched therebetween.

Moreover, according to various embodiments of the present invention, combining the button body with the fastening member is basically carried out by allowing the stepped portion edge of the button body to stick into the shank proximal portion of the fastening member as described above. Therefore, in the button body according to various embodiments of the present invention, there is no need to provide a hole portion whose hole diameter gradually decreases toward the shank receiving open end in order to undetachably hold the deformed and expanded portion of the fastening member such as the axial hole 36 of the die cast bar 30 disclosed in the '642 application. Therefore, according to various embodiments, when the button body is formed by die casting, a secondary process such as a squeeze process after the die casting is not necessary. Consequently, according to various embodiments of the present invention, the button body can be obtained as a solid die cast product.

Furthermore, when the shank receiving stepped portion of the button body bumps into the shank stepped portion of the fastening member allowing the stepped portion edge to stick into the shank proximal portion, the top of the shank distal end does not come in contact with the closed bottom of the shank receiving small diameter portion. Therefore, the force making the stepped portion edge pierce into the shank proximal portion is not transmitted from the top of the shank distal end to a button body surface part concentric with the shank receiving small diameter portion. Consequently, it is possible to remove restrictions on design of a button body surface due to a force transmitted to the surface of a conventional button body. Moreover, according to various embodiments of the present invention, the button body surface part does not receive any force at the time of the fitting, so the shank receiving small diameter portion can extend through the button body to the surface thereof to open.

According to various embodiments, examples of a material of the button body (and the fastening member) include metals such as aluminum and zinc, and alloys thereof.

In one embodiment of the present invention, the shank receiving large diameter portion can receive only a part of the shank proximal portion on the distal side, and the other part of the shank proximal portion on the proximal side which cannot go into the large diameter portion collapses while expanding outwardly in a radial direction when the button body is combined with the fastening member. When the button body and the fastening member are pressed to each other to attach them to the cloth, the shank distal end which has passed through the cloth enters the shank receiving small diameter portion. At this time, since the axial length of the shank receiving small diameter portion is larger than that of the shank distal end, the shank stepped portion bumps into the shank receiving stepped portion, which prevents the shank distal end from further going into the shank receiving small diameter portion, before the top of the shank distal end reaches the closed bottom of the shank receiving small diameter portion. In addition, the force is applied from the shank receiving stepped portion to the shank stepped portion, and this force allows the part of the shank proximal portion on the proximal side outside the shank receiving large diameter portion to collapse in the vertical direction while expanding outwardly in the radial direction. Consequently, the cloth is sandwiched between a part of the button body and the expanded and deformed part of the fastening member, and the button body is combined with the fastening member via the cloth. According to this embodiment of the present invention, the button body is fitted to the fastening member by deforming the shank proximal portion, and it is possible to adjust an interval between the button body and the fastening member according to the thickness of the cloth to be held therebetween.

According to a particular embodiment of the present invention, the shank distal end includes a tip edge having an angle less than 90 degrees in vertical section. This shank tip edge can cut and hold a part of the cloth between the edge and the shank receiving stepped portion edge of the button body, when the shank distal end passes through the cloth.

In one embodiment of the present invention, the stepped portion edge projects toward the large diameter portion at an angle less than 90 degrees in vertical section. This stepped portion edge sticks into the shank proximal portion from the shank stepped portion when the shank proximal portion is received in the large diameter portion, firmly fitting the button body to the fastening member.

In one embodiment of the present invention, the stepped portion edge of the shank receiving space of the button body can stick into the shank proximal portion from the shank stepped portion of the fastening member to combine the button body with the fastening member via the cloth therebetween. Therefore, in the button body, there is no need to be subjected to a secondary or an additional process such as the squeeze process after the die casting, and therefore the button body can be obtained only from the die casting step. Moreover, when the button body is attached to the cloth, the concentric part of the button body surface with respect to the shank receiving small diameter portion does not receive any force, and hence a degree of freedom for the design of this surface part can increase. For example, this surface part may be thinned, and glass or the like vulnerable to impact can be embedded in this part.

BRIEF DESCRIPTION OF THE DRAWINGS

Having thus described various embodiments of the invention in general terms, reference will now be made to the accompanying drawings, which are not necessarily drawn to scale, and wherein:

FIG. 1 is a vertical sectional view showing a bar and a rivet constituting a button according to one embodiment of the present invention;

FIG. 2 is a vertical sectional explanatory view showing the initial stage of a step of attaching the button to cloth;

FIG. 3 is a vertical sectional explanatory view showing the intermediate stage of the step of attaching the button to the cloth;

FIG. 4 is a vertical sectional explanatory view showing the final stage of the step of attaching the button to the cloth;

FIG. 5 is a vertical sectional explanatory view showing the final stage of the step of attaching the button to thicker cloth; and FIG. 6 is a vertical sectional view showing a modification of the bar of the button according to the present invention.

DETAILED DESCRIPTION OF VARIOUS EMBODIMENTS OF THE INVENTION

Various embodiments of the invention are described more fully hereinafter with reference to the accompanying drawings, in which some, but not all embodiments of the invention are shown in the figures. These inventions may be embodied in many different forms and should not be construed as limited to the embodiments set forth herein. Rather, these embodiments are provided so that this disclosure will satisfy applicable legal requirements.

One embodiment of the present invention will hereinafter be described with reference to the accompanying drawings. FIG. 1 is a vertical sectional view showing a bar 10 as a button body and a rivet 20 as a fastening member constituting a button according to one embodiment of the present invention. The bar 10 is a solid die-cast product made of a zinc alloy and includes a comparatively thick disc-like bar main body 11 having an upper surface 11*a*, a side surface 11*b*, a bottom surface 11*c*, a projecting bottom portion 12, and a shank receiving space 13 for receiving a shank 22 of the rivet 20, which is described later. The upper surface 11*a* and the side surface 11*b* form the appearance of the button, and the projecting bottom portion 12 projects downwardly from the bottom surface 11*c*. The shank receiving space 13 is formed in a recess-like shape upward from a lower end face 12*a* of the projecting bottom portion 12 along the central axis of the bar main body 11.

The shank receiving space 13 is separated into an upper shank receiving small diameter portion 13*a* having a relatively small diameter and a lower shank receiving large diameter portion 13*b* having a diameter larger than that of the small diameter portion 13*a*, and on a boundary between the small diameter portion 13*a* and the large diameter portion 13*b*, a shank receiving stepped portion 13*c* is formed. The shank receiving stepped portion 13*c* has a stepped portion edge 13*d* around a boundary with the small diameter portion 13*a*. The stepped portion edge 13*d* projects downwardly forming an angle less than 90 degrees (about 30 degrees in the present embodiment) in vertical section with respect to the wall surface forming the small diameter portion 13*a*. The axial length of the small diameter portion 13*a* is set to a length somewhat larger than the axial length of a shank distal end 22*a* of the rivet 20 described later. Moreover, a closed bottom (the upper end) 13*a*' of the small diameter portion 13*a* is positioned somewhat below the middle of the bar main body 11 in a vertical direction. The axial length of the large diameter portion 13*b* is smaller than that of the small diameter portion 13*a*, and is about half of the axial length of the small diameter portion in this embodiment. Furthermore, the projecting bottom portion 12 has a lower end 12*a* around the open end of the large diameter portion 13*b* and an inclined portion 12*b* formed such that the height thereof from the bottom surface 11*c* gradually decreases from the lower end 12*a* outwardly in the radial direction. The position of the stepped portion 13*c* in the vertical direction is around the middle of the inclined portion 12*b*.

The rivet 20 includes a comparatively thin disc-like base 21 and a shank 22 extending upwardly from the upper surface of the base 21 along its central axis. The shank 22 has a shank distal end 22*a* which has a relatively small diameter and which is to be inserted into the small diameter portion 13*a* of the shank receiving space 13 of the bar 10. The shank 22 also includes a shank proximal portion 22*b* below the distal end 22*a*, and the shank proximal portion 22*b* has a diameter larger than that of the shank distal end 22*a*. Between the distal end 22*a* and the proximal portion 22*b*, a shank stepped portion 22*c* is formed. The stepped portion 22*c* has an annular small depression 22*d* around a boundary with the distal end 22*a*. The depression 22*d* receives the above-mentioned stepped portion edge 13*d* on the side of the bar 10. The outer diameter of the shank distal end 22*a* is slightly smaller than the inner diameter of the shank receiving small diameter portion 13*a*, and the axial length of the distal end 22*a* is set to a length smaller than the axial length of the small diameter portion 13*a*. Moreover, the outer diameter of the shank proximal portion 22*b* is slightly smaller than the inner diameter of the shank receiving large diameter portion 13*b*, and the axial length of the proximal portion 22*b* is much larger than that of the large diameter portion 13*b*. Furthermore, the top of the shank distal end 22*a* is provided with a generally mortar-like recess 22*e*.

Around the top of the distal end 22*a*, there is formed a tip edge 22*f* forming an angle less than 90 degrees (about 45 degrees in the present embodiment) in vertical section with respect to the outer peripheral surface of the distal end 22.

Next, a process of fixing the above-mentioned button to the cloth with reference to FIGS. 2 to 4 is described. When the bar 10 is attached to a predetermined position of cloth f, as well known, the bar 10 is held by an upper attachment die of a press machine (not shown), while the rivet 20 is held on a lower support die (not shown) concentrically arranged with the upper die, with the cloth f placed therebetween. After that, when the upper die is lowered, as shown in FIG. 2, the cloth f is sandwiched and then cut between the shank tip edge 22*f* of the rivet 20 and the stepped portion edge 13*d* of the bar 10. It is to be noted that in a case where a shank of a conventional button which does not have such upper and lower edges 13*d*, 22*f* is passed through the cloth, the cloth is pulled on a shank side, and the cloth easily creases. In the button according to this embodiment, however, the cloth can be cut by the upper and lower edges 13*d*, 22*f*, and hence the cloth does not easily crease.

From the state of FIG. 2, the shank distal end 22*a* passes through the cloth f, taking along the cut cloth portion f' in the shank distal end recess 22*e*, and enters the shank receiving small diameter portion 13*a* as shown in FIG. 3. Before the top of the distal end 22*a* reaches the closed bottom 13*a*' of the small diameter portion 13*a*, the insertion of this shank distal end 22*a* into the small diameter portion 13*a* is restricted by the stepped portion 22*c* bumping into the shank receiving stepped portion 13*c* as the axial length of the distal end 22*a* is smaller than that of the small diameter portion 13*a*. It is to be noted that as described above, the circularly cut portion f' of the cloth f is accommodated in the shank receiving small diameter portion 13*a*, so it is unnecessary to discard the cut cloth portion f'. The upper and lower stepped portions 13*c*, 22*c* contact against each other holding a cloth portion therebetween, and subsequently the stepped portion edge 13*d* sticks in the depression 22*d* of the shank stepped portion 22*c* on the rivet side. After that, as shown in FIG. 4, the edge 13*d* sticks into the shank proximal portion 22*b* downward and inwardly in the radial direction. Simultaneously with the edge 13*d* piercing the proximal portion 22*b*, the shank receiving stepped portion 13*c* presses the shank stepped portion 22*c* downward, causing the shank proximal portion 22*b* to collapse in the vertical direction while expanding outwardly in the radial direction. At this time, the distal side part of the proximal portion 22*b* which has come into the shank receiving large diameter portion 13*b* is inhibited from being deformed outwardly in the radial direction by the wall surface of the large diameter portion 13*b*. Therefore, the remaining part of the shank proximal portion 22*b* on proximal side which is outside the large diameter portion 13*b* collapses in the vertical direction while expanding outwardly in the radial direction larger than the diameter of the large diameter portion 13*b*. The reference numeral 22*b*' in FIG. 4 represents the deformed proximal side part of the shank proximal portion 22*b*. In this case, the distal side part of the shank proximal portion 22*b* is held in the shank receiving large diameter portion 13*b*, whereby the proximal side part of the shank proximal portion 22*b* can be evenly deformed outwardly in the radial direction, and a central deviation between the bar 10 and the rivet 20 can be prevented. At the time of this deformation, the projecting bottom portion 12 of the bar 10 further presses the cloth f, and then the cloth f is sandwiched between the lower end 12*a* of the projecting bottom portion 12 and the deformed part 22*b*' of the shank proximal portion 22*b* to be firmly held between the rivet base 21 and the projecting bottom portion 12 plus the bar main body bottom surface 11*c*.

FIG. 5 is a vertical sectional view explanatorily showing a final attachment stage of the bar 10 and the rivet 20 described above to cloth F which is thicker than the cloth f. As is the case with the above, the top of the shank distal end 22*a* does not reach the closed bottom 13*a*' of the shank receiving small diameter portion 13*a*, and the shank stepped portion 22*c* bumps into the shank receiving stepped portion 13*c*, forcing the stepped portion edge 13*d* to stick into the shank proximal portion 22*b*. This sticking effect is similar to that in the embodiment with the thin cloth f. On the other hand, the deformation of a proximal side part 22*b*" outside the shank receiving large diameter portion 13*b* decreases as compared with the case of the thin cloth f. That is, the degree of a collapse and a radial expansion of the proximal side part 22*b*" of the shank proximal portion 22*b* is less than the corresponding part 22*b*' with the cloth f. Thus, in the button according to various embodiments of the present invention, it is possible to adjust the amount of a deformation of the proximal side parts 22', 22" of the shank proximal portion 22*b* with respect to the thickness of cloth f, F.

FIG. 6 is a vertical sectional view showing a modification of the above-mentioned bar 10 according to another embodiment of the invention. In this bar 10, the inner diameter of the shank receiving large diameter portion 13*b*' is gradually increased downward to the open end of the shank receiving space 13 so that the inner peripheral surface of the shank receiving large diameter portion 13*b*' inclines to the open end outwardly in the radial direction. This inclined surface of the shank receiving large diameter portion 13*b*' can cause the shank proximal portion 22*b* to deform more evenly outward in the radial direction when the bar 10 is attached to the cloth f. As with above mentioned embodiment, the bar 10 and the rivet 20 are fitted to each other via the cloth f, by sticking the stepped portion edge 13*d* into the shank proximal portion 22*b* and deforming the shank proximal portion 22*b* as mentioned above. The other portions of the button according to this embodiment are common to the embodiment described above in relation to FIGS. 1-5, and therefore are represented using the same reference numerals as are used in FIGS. 1-5.

As described above, according to various embodiments of the present invention, the bar 10 of the button does not have any portion that has to be subjected to a secondary process such as the squeeze process after the die casting. Therefore, the button can easily be manufactured, and cost reduction can be achieved. Moreover, when the shank receiving stepped portion 13*c* presses the shank stepped portion 22*c* to deform the shank proximal portion 22*b*, the top of the shank distal end 22*a* does not come in contact with the closed bottom 13*a*' of the shank receiving small diameter portion 13*a*. Therefore, no force is transmitted from the shank distal end 22*a* to the closed bottom 13*a*', and hence the part of the bar main body 11 which is an extension of the small diameter portion 13*a* does not receive any force. Consequently, the center of the bar upper surface 11*a* corresponding to the extended part can be provided with a design which could not be provided on a conventional bar subjected to the force in an attachment or fitting step. For example, the center of the upper surface 11*a* can be thinned, and glass or the like vulnerable to impact can be embedded in this part. Alternatively, the button can be designed so that the small diameter portion 13*a* extends through the bar front surface 11*a* to open.

Although this invention has been described in specific detail with reference to the disclosed embodiments, it will be understood that many variations and modifications may be effected within the spirit and scope of the invention as described in the appended claims.

What is claimed is:

1. A button comprising:

a button body; and a fastening member fitted to the button body via a cloth, the fastening member comprising a base and a shank extending from the base, the shank comprising a shank distal end having a relatively small diameter, a shank proximal portion having a diameter larger than that of the shank distal end, and a shank stepped portion disposed between the distal end and the proximal portion, wherein the button body has a shank receiving space for receiving the shank which has passed through the cloth, the shank receiving space comprising a shank receiving small diameter portion which receives the shank distal end and which has an axial length larger than that of the distal end, a shank receiving large diameter portion which receives at least a part of the shank proximal portion, and a shank receiving stepped portion between the small diameter portion and the large diameter portion, the shank receiving stepped portion having a stepped portion edge around a boundary with the small diameter portion, and wherein the shank distal end has a recess at a top of the shank distal end, and the recess defines a tip edge forming an angle less than 90 degrees in vertical section with respect to an outer peripheral surface of the shank distal end.

2. The button according to claim 1, wherein the stepped portion edge projects toward the large diameter portion at an angle less than 90 degrees in vertical section.

3. The button according to claim 1, wherein the button body is a solid die-cast product.

4. The button according to claim 1, wherein the shank stepped portion defines an annular depression around a boundary with the shank distal end.

5. A button comprising:

a button body; and a fastening member fitted to the button body via a cloth, the fastening member comprising a base and a shank extending from the base, the shank comprising a shank distal end having a relatively small diameter, a shank proximal portion having a diameter larger than that of the distal end, and a shank stepped portion disposed between the distal end and the proximal portion, wherein the button body has a shank receiving space for receiving the shank which has passed through the cloth, the shank receiving space comprising a shank receiving small diameter portion which receives the shank distal end and which has an axial length larger than that of the distal end, a shank receiving large diameter portion which receives at least a part of the shank proximal portion, and a shank receiving stepped portion between the small diameter portion and the large diameter portion, the shank receiving stepped portion having a stepped portion edge around a boundary with the small diameter portion, wherein the shank distal end has a recess at a top of the shank distal end, and the recess defines a tip edge forming an angle less than 90 degrees in vertical section with respect to an outer peripheral surface of the shank distal end, and wherein the button body is combined with the fastening member by making the shank stepped portion bump into the shank receiving stepped portion, causing the stepped portion edge to stick into the shank proximal portion.

6. The button according to claim 5, wherein the shank receiving large diameter portion can receive only a part of the shank proximal portion on the distal side, and the other part of the shank proximal portion on the proximal side which cannot go into the shank receiving large diameter portion collapses while expanding outwardly in a radial direction when the button body is combined with the fastening member.

7. The button according to claim 5, wherein the stepped portion edge projects toward the large diameter portion at an angle less than 90 degrees in vertical section.

8. The button according to claim 5, wherein the button body is a solid die-cast product.

9. The button according to claim 5, wherein the shank stepped portion defines an annular depression around a boundary with the shank distal end.

* * * * *